US006171170B1

(12) United States Patent
Lin

(10) Patent No.: US 6,171,170 B1
(45) Date of Patent: Jan. 9, 2001

(54) MUSICAL ROTATING LUMINOUS DEVICE

(76) Inventor: Cheng-Chung Lin, P.O. Box No.6-57, Chung-Ho City, Taipei Hsien 235 (TW)

( * ) Notice: Under 35 U.S.C. 154(b), the term of this patent shall be extended for 0 days.

(21) Appl. No.: 09/472,904

(22) Filed: Dec. 27, 1999

(51) Int. Cl.[7] ..... A63H 5/00
(52) U.S. Cl. ..... 446/404; 446/397; 446/485
(58) Field of Search ..... 446/3, 81, 219, 446/397, 404, 408, 44, 485

(56) References Cited

U.S. PATENT DOCUMENTS

| | | | | |
|---|---|---|---|---|
| 3,747,266 | * | 7/1973 | Ono | 434/397 X |
| 5,032,099 | * | 7/1991 | Chan | 434/404 X |
| 5,310,377 | * | 5/1994 | Joja | 434/397 X |
| 5,324,224 | * | 6/1994 | Anderson et al. | 434/219 X |
| 5,736,659 | * | 4/1998 | Kyle, Jr. | 434/404 X |

* cited by examiner

*Primary Examiner*—Sam Rimell

(74) *Attorney, Agent, or Firm*—Dougherty & Troxell

(57) ABSTRACT

A type of musical rotating luminous device is composed of a base, retarding device, rotating stand, outer shell and a luminous device. It utilizes the battery's power within the base to make the motor drive the retarding device. Within the said rotating stand, a central shaft is connected to a retarding device. At one end of the central shaft, a drive sprocket is fitted on, while the other end is attached to a stand's rotary wheel. Additionally, in each corner of a containment space, a plurality of shaft rods pass through the stand. At the other end of the shaft rods, drive sprockets of different diameter sizes are attached. Between the shaft rods and the central shaft the drive sprockets engage a plurality of driven sprockets, transferring the driven force. Furthermore, the outer shell houses the said base, retarding device and rotating stand. When in use, and due to the different diameter sizes of the drive sprockets, the central shaft and the shaft rods will spin at different speeds. Moreover, the luminous device will flash a colorful and eye-catching light, creating a type of free spinning, safely interesting, visually beautiful and multi functional children's toy.

7 Claims, 6 Drawing Sheets

MUSICAL ROTATING LUMINOUS DEVICE

BACKGROUND OF THE INVENTION (a) Field of the Invention

This invention is a type of musical rotating luminous device. More specifically, it freely turns and flashes an eye-catching light, making it a safely interesting and a visually beautiful children's toy.

(b) Description of the Prior Art

Economic growth increases society's diversity as well as people's standard of living, there is an ever growing number of products available to the public. Since children are our nation's future leaders, children's toys and articles of necessity flood the market. Parents are offered a wide variety of toy cars, dolls, building blocks and other toys. Therefore, this 'Sunrise Industry' of children's toys, is an expanding business opportunity, which is being actively plied by entrepreneurs.

Most children love today's average musical toy. However, their functions do not go beyond the installation of a musical device that is assembled within, as well as an attractive light. Nevertheless, some children's musical toys produce too much noise and their applications don't meet manufacturing standards, which easily cause harm to children. Additionally, some light-producing children's toys focus their light on a single point or single surface, making it unable to show any beauty and causing a waste of electricity.

Due to the conventional children toys' drawbacks, this inventor drew from many years of experience in the children's toy industry and from professional technology, in order to invent this new musical rotating luminous device.

SUMMARY OF THE INVENTION

The main purpose of this invention is to offer a type of free turning as well as a flashing, colorful and eye-catching luminous device, which is a safely interesting and visually beautiful, multi functional musical rotating luminous device. This invention is composed of a base, retarding device, rotating stand, outer shell and luminous device. During operations, a battery within the base powers a motor that drives the retarding device. The central shaft within the said rotating stand is connected to the retarding device. One end of the central shaft is attached to a drive sprocket while the other end is mounted upon a disk's rotary wheel. Additionally, each containment space's corner has a plurality of shaft rods piercing through the disk. At the end of each shaft rod are drive sprockets of different diameter sizes. Between the shaft rods and the central shaft the drive sprocket engages with a plurality of driven sprockets, whereby the driven force is transferred. The base, retarding device and the rotating stand are housed within the outer shell. Additionally, a luminous device is fitted into the outer shell's fastening section. As its running, the drive sprockets of different diameters drive the central shaft and shaft rods at different rotating speeds. Also, the luminous device illuminates a colorful, eye-catching light.

BRIEF DESCRIPTION OF THE DRAWINGS

In order for the examiner to better understand this invention, its functions and features, the following detailed diagrams are provided.

DESCRIPTION OF THE PREFERRED EMBODIMENT

Figure 1:
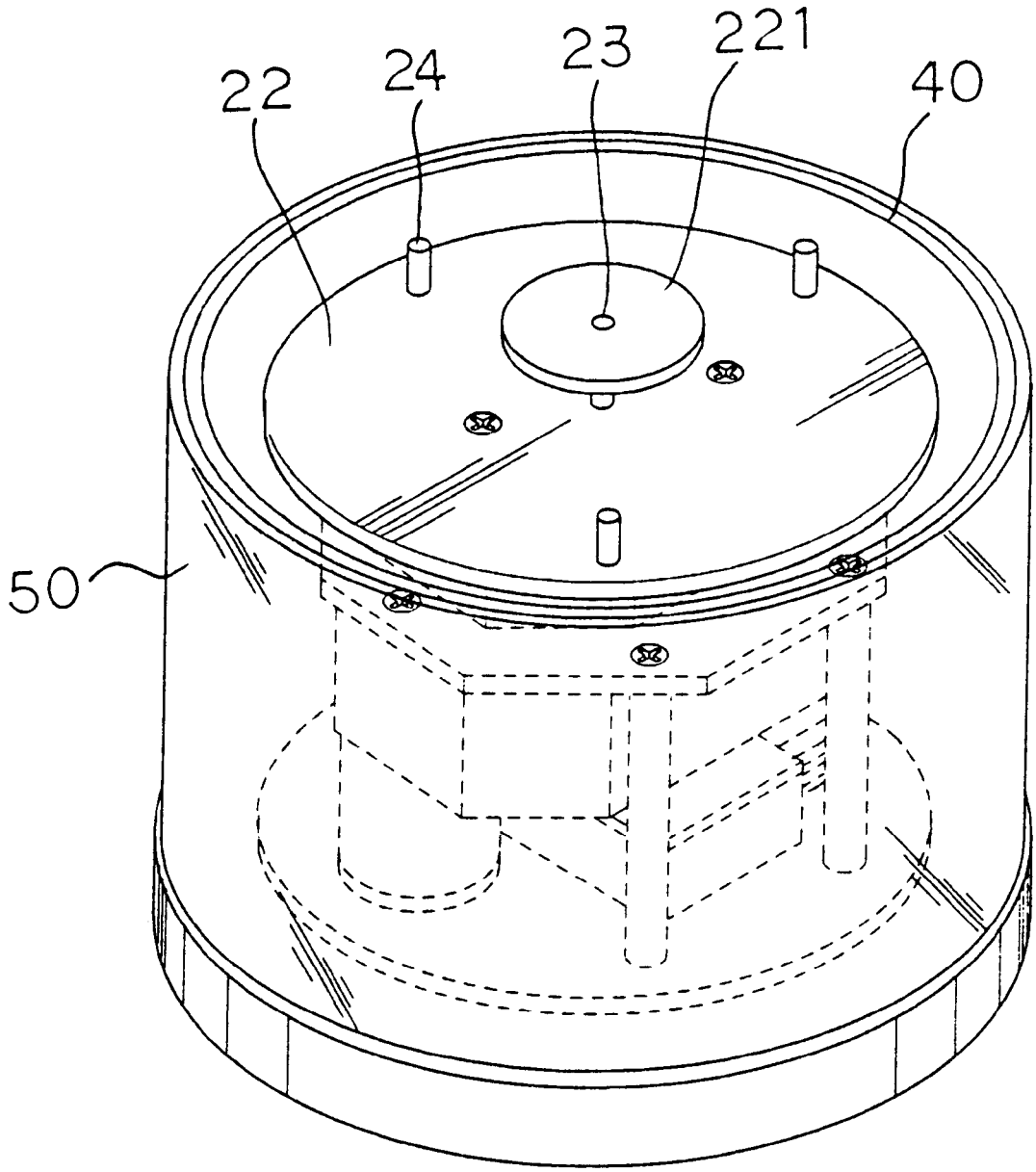
FIG. 1 is a perspective drawing of the invention.
Figure 2:
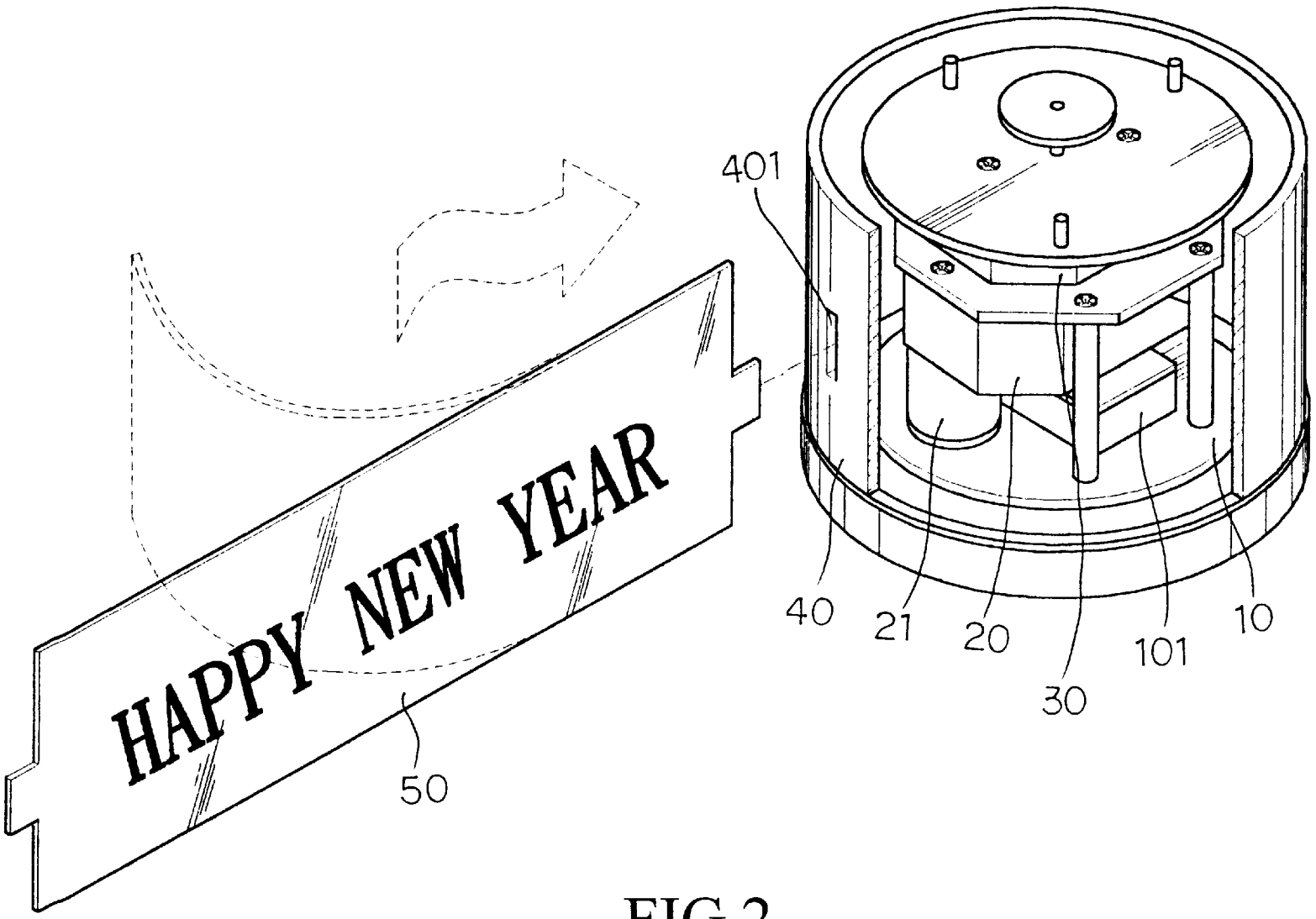
FIG. 2 is a cross-sectional perspective of the invention.

Please refer to FIGS. 1 and 2, which are a perspective drawing of the invention and a cross-sectional perspective of the invention, respectively. The invention is composed of the base 10, retarding device 20, rotating stand 30, outer shell 40, and a luminous device 50. Within the base 10 a battery can be inserted into the containment space 101. Motor 21 is connected to the battery and said motor 21 acts as the power source to drive retarding device 20. Upon rotating stand 30 is a disk 22.

Figure 3:
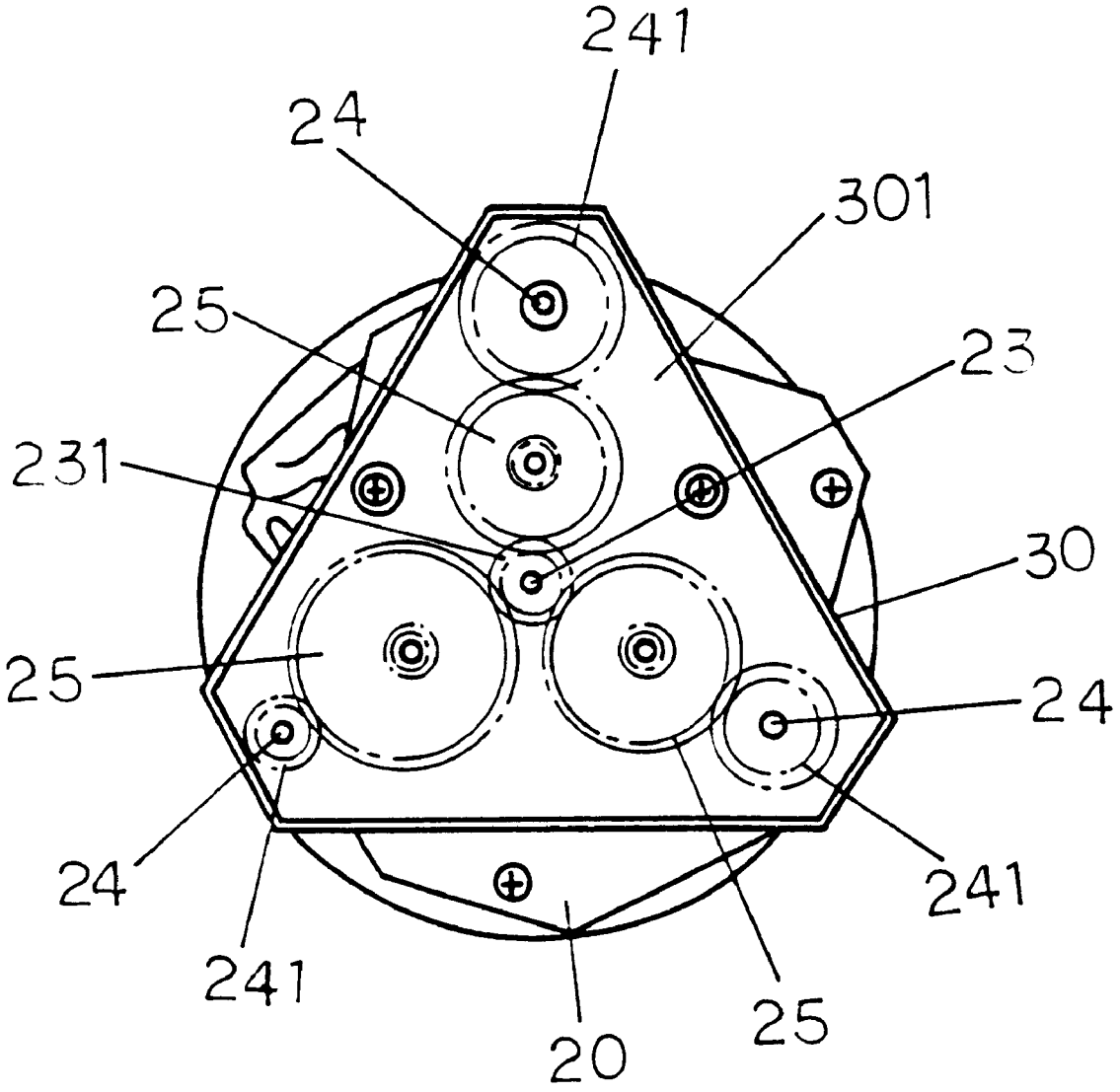
FIG. 3 is a plan view of the rotating stand.

Please refer to FIG. 3, which is a visual perspective of the rotating stand. A gear room 301 is set within this invention's rotating stand 30. Situated at the middle of the said gear room 301 is a central shaft 23. The said central shaft 23 is connected with the retarding device 20. One end of the said central shaft 23 is attached to drive sprocket 231, while the other end is fitted to the disk 22's rotary wheel 221. Additionally, in each corner of the said gear room 301, shaft rods 24 pierce through the disk 22. Each shaft rod 24 has a drive sprocket 241, each having diameters of a different size. Between the said shaft rods 24 and the central shaft 23 are driven sprockets 25, which are engaged and driven by drive sprockets 241 and 231. This causes shaft rods 24 to turn with central shaft 23, yet turning at different speeds.

Contained within the outer shell 40 are the said base 10, retarding device 20 and the rotating stand 30. This is properly set upon the fastening section 401. The said fastening section 401 is for plugging in and fastening the luminous device 50 into a socket or adhesion strip. The said luminous device 50 is constructed from an electrical luminescence (EL) board, an EL chip or an EL strip. Different lettering or phrases can be inserted into this device. Power from the battery is used to run the EL device.

When this invention is running, the motor 21 will produce a force. At the same time, the luminous device 50 flashes colorful, eye-catching lights. After the retarding device 20 reduces the speed, the force drives the central shaft 23. At this time, rotating stand 30 turns with central shaft 23. In each corner of the said rotating stand 30, shaft rods 24 pierce through disk 22. In this way, central shaft 23's drive sprocket engages the driven sprockets 25. This, in turn, transfers the force to the three shaft rods 24, via the drive sprockets 241 at their bottom. Since the diameters of the sprockets are different, this causes each shaft rod 24 to rotate at a different speed.

Figure 4:
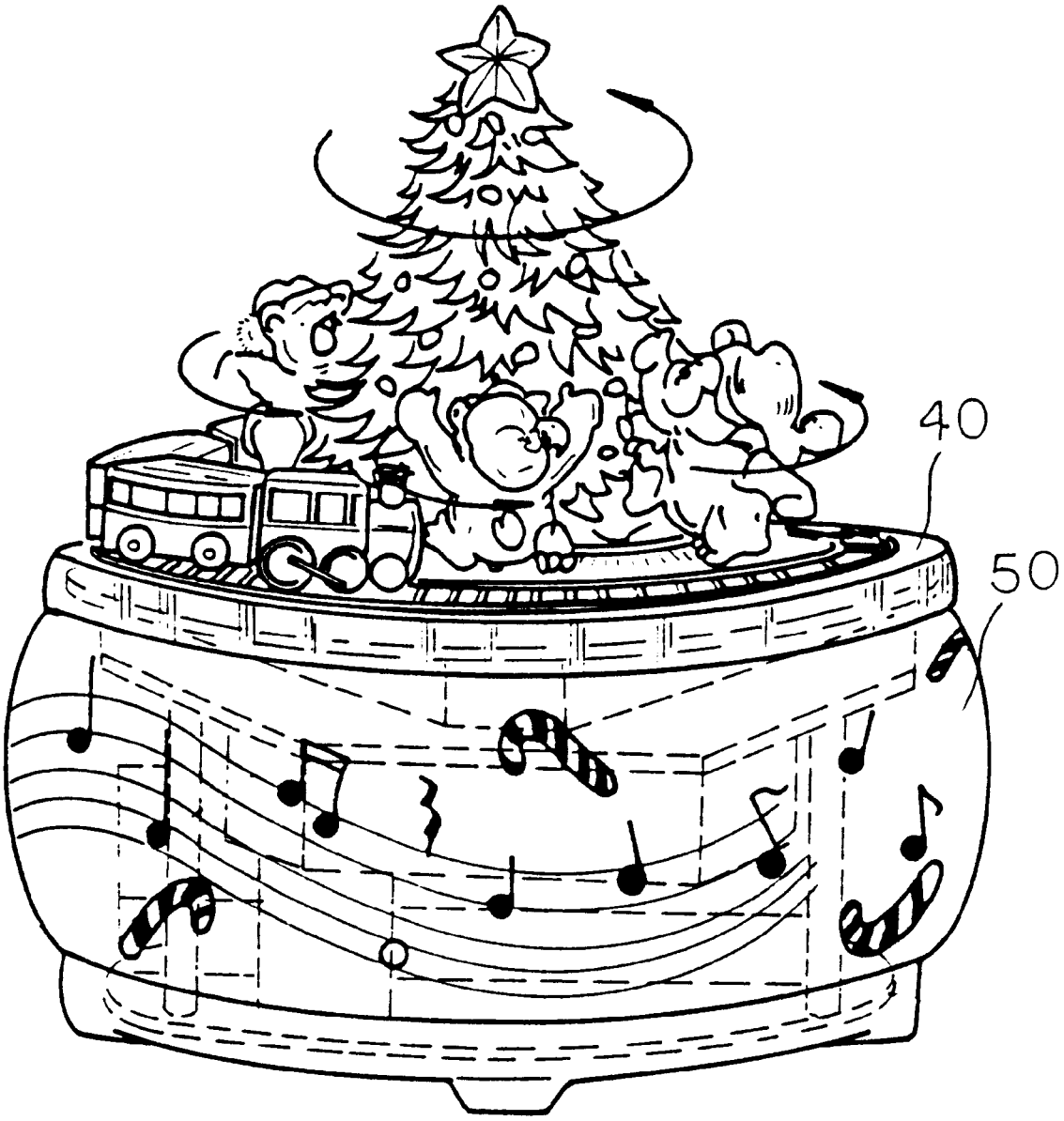
FIG. 4 is a side view of the invention in use.
Figure 5:
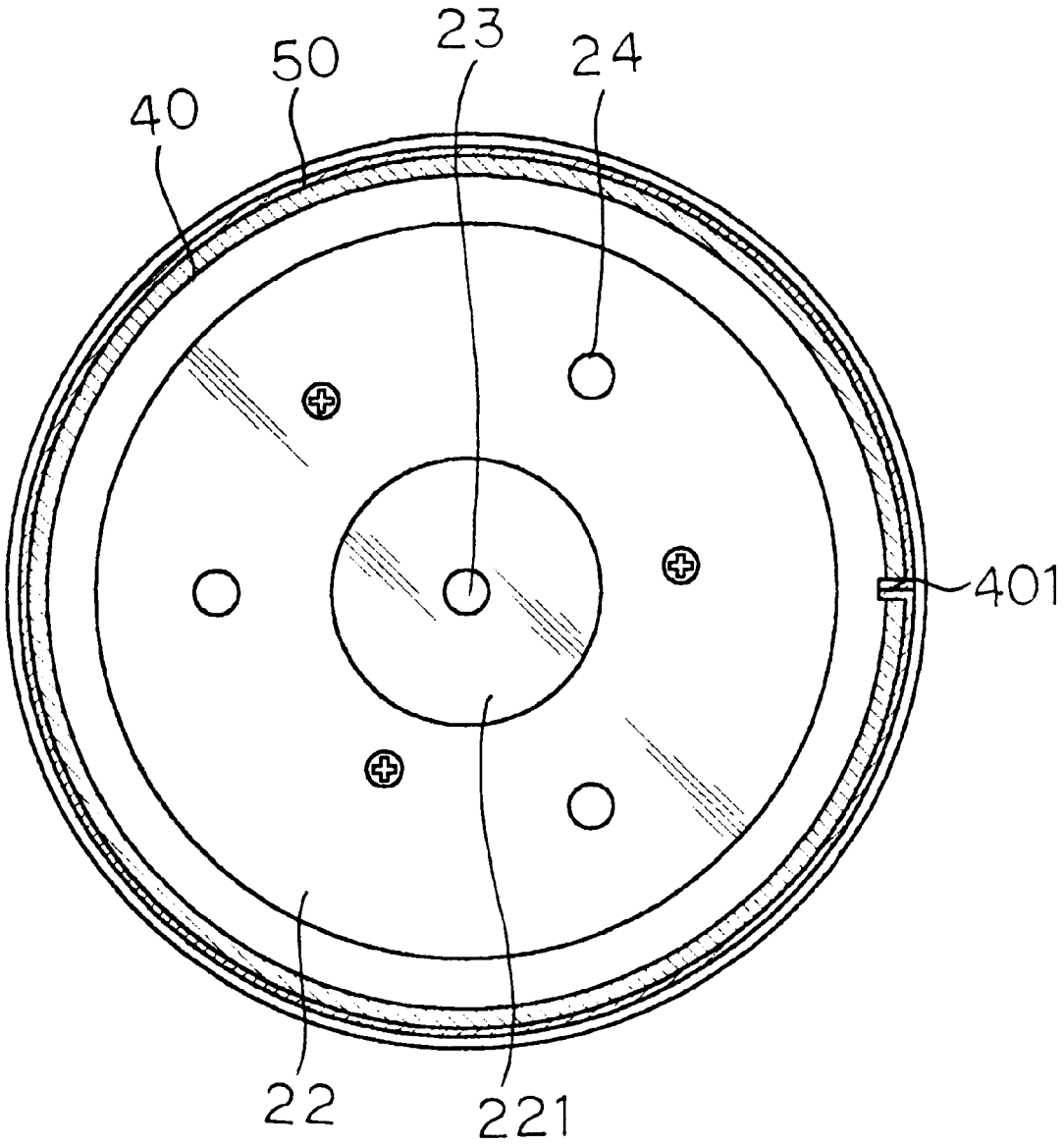
FIG. 5 is a plan view of the invention's electrical luminescence (EL) assemblage.

Please refer to FIG. 4, which is a better perspective of the invention in use. A Christmas tree is fitted upon the disk 22's rotary wheel 221. Furthermore, where each of the shaft rods 24 pierce through disk 22, a cute bear is set, while other appropriate decorations adorn the exterior. Additionally, the outer shell 40 is fitted with a fastening section 401, which is designed for a socket or an adhesion strip. As FIG. 5 illustrates, the luminous chip can be wrapped in a clockwise or counter clockwise manner, then inserted and fastened. Moreover, for its array of songs, there are many different pictures for the luminous chip to display. Since the disk 22's three pierced through shaft rods 24 rotate at different speeds, when it is turned on, the bears upon the shaft rods 24 appear as if they're dancing with the music, but each dancing a different step upon the rotating stage. At the same time, the outer shell 40's luminous chip flashes a colorful, eye-catching, music conducted light, making it a lively and active children's toy, causing people to pick it up and not want to put it down.

Figure 6:
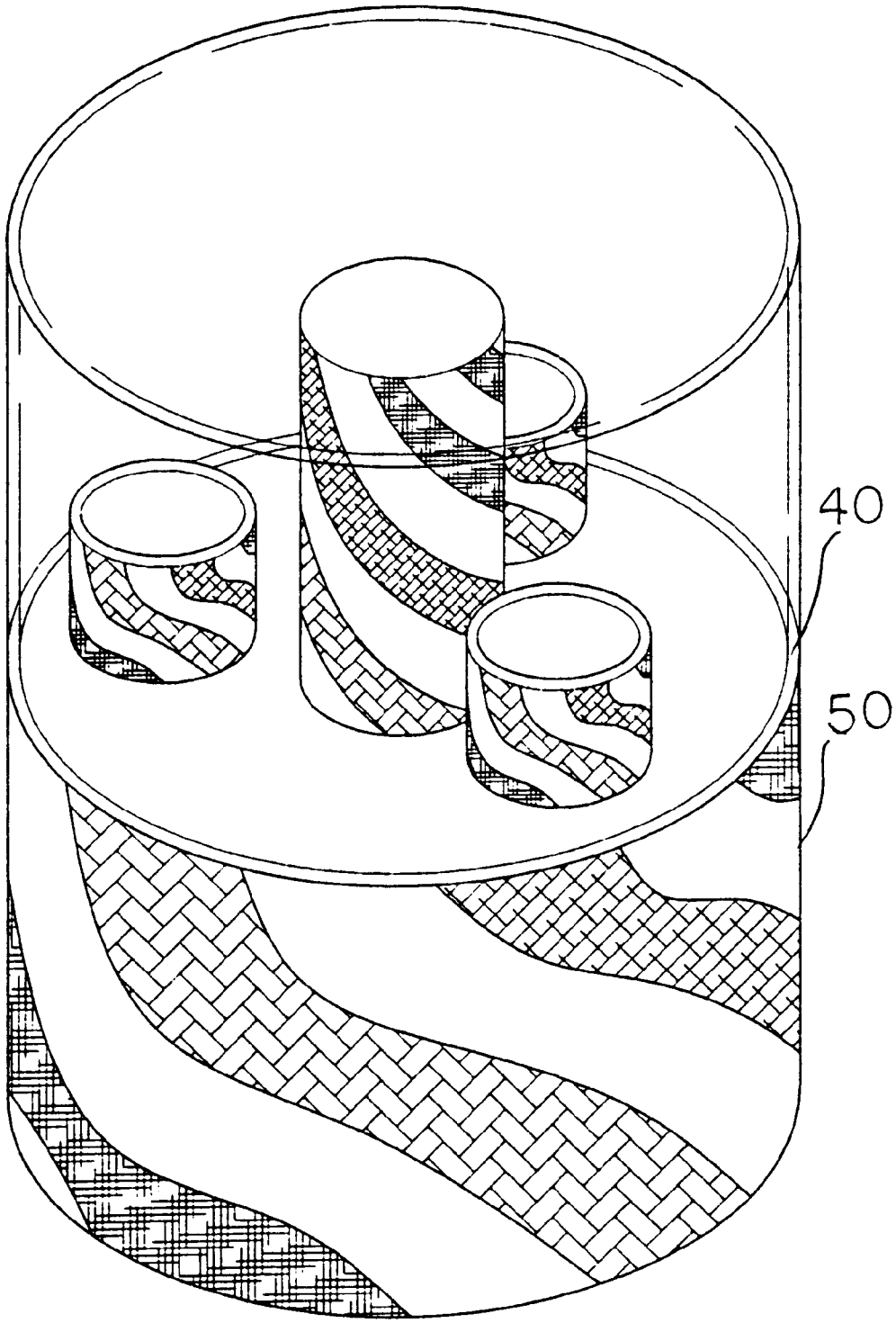
FIG. 6 is another practical diagram of the invention.

As FIG. 6 shows, this invention can also place a colorful flowerpot upon the disk 22's rotary wheel 221. Moreover, three colorful cups can be placed upon each of the disk 22's pierced through shaft rods 24, while installing the outer shell 40's luminous chip. Upon this are abundantly colorful veins. When this is running, the colorful flowerpot and the three colorful cups spin at different speeds. As the colors turn and change with the movement, an array of colorful styles will appear. At the same time, the luminous chip's abundantly colorful veins will flash together, producing a beautiful and eye-catching light.

As previously mentioned, this musical rotating luminous device is far better than conventional musical children's toys and is more interesting. The foregoing structure and effective features make this invention a new product. As well as having an improved effectiveness, it meets the criteria for patent application. It is hoped that this invention's application will be approved at the earliest possible date.

In defining the scope of this invention, references should be made to the appended claims and diagrams rather than to the foregoing specifications. This invention may be embodied in other forms without departing from the spirit or essential attributes thereof.

What is claimed is:

1. A luminous rotating amusement device comprising:

a) a base having an outer shell thereon, the outer shell bounding a space;

b) a motor located on the base within the space bounded by the outer shell;

c) a disk located within the space bounded by the outer shell;

d) a central shaft rotatably extending through a center of the disk, the central shaft being rotated by the motor and having thereon a central drive sprocket and rotary wheel;

e) a plurality of auxiliary shaft rods rotatably extending through the disk at locations spaced from the central shaft, each auxiliary shaft rod having an auxiliary drive sprocket thereon;

f) a plurality of driven sprockets each having a diameter different than the other driven sprockets, each driven sprocket engaging the central drive sprocket and one of the plurality of auxiliary drive sprockets, whereby rotation of the central shaft causes rotation of the auxiliary shaft rods at different rotational speeds; and, g) a luminous device attached to the outer shell.

2. The luminous, rotating amusement toy of claim 1 further comprising:

a) a main decorative article located on the rotary wheel; and, b) an auxiliary decorative article mounted on each of the plurality of auxiliary shaft rods.

3. The luminous, rotating amusement toy of claim 1 wherein the luminous device is removably attached to the outer shell.

4. The luminous, rotating amusement toy of claim 3 further comprising:

a) a fastening section formed on the outer shell; and, b) a plurality of tabs extending from the luminous device and engaging the fastening section.

5. The luminous, rotating amusement toy of claim 1 wherein the luminous device comprises an electrical luminescence device.

6. The luminous, rotating amusement toy of claim 1 further comprising a retarding device operatively connected to the motor and the central shaft.

7. The luminous, rotating amusement toy of claim 1 wherein the motor is powered by batteries and further comprising a battery containment box on the base.

* * * * *